US011378281B2

(12) United States Patent
Braden et al.

(10) Patent No.: US 11,378,281 B2
(45) Date of Patent: Jul. 5, 2022

(54) HOME APPLIANCE HAVING A LOW BACK REAR VENT TRIM

(71) Applicants: BSH Home Appliances Corporation, Irvine, CA (US); BSH Hausgeräte GmbH, Munich (DE)

(72) Inventors: Ben Braden, Lafollette, TN (US); Ronald Allen Diehl, LaFollette, TN (US); Josiah Fronckowiak, LaFollette, TN (US); Ian McIver, Knoxville, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 314 days.

(21) Appl. No.: 16/591,658

(22) Filed: Oct. 3, 2019

(65) Prior Publication Data

US 2021/0102710 A1 Apr. 8, 2021

(51) Int. Cl.
*F24C 15/20* (2006.01)
*F24C 15/36* (2006.01)

(52) U.S. Cl.
CPC ..... *F24C 15/2042* (2013.01); *F24C 15/36* (2013.01)

(58) Field of Classification Search
None
See application file for complete search history.

(56) References Cited

U.S. PATENT DOCUMENTS

| | | | | |
|---|---|---|---|---|
| 2,526,890 | A | 10/1950 | Mendel | |
| 2,755,791 | A | 7/1956 | Chambers et al. | |
| 3,367,325 | A * | 2/1968 | O'Keefe | A61H 33/025 601/168 |
| 3,906,744 | A * | 9/1975 | Knapp | A47B 31/02 62/384 |
| 4,021,642 | A | 5/1977 | Fields, Jr. | |
| 2016/0178218 | A1 | 6/2016 | Kulemin et al. | |
| 2017/0030589 | A1* | 2/2017 | Braden | F24C 15/2007 |
| 2020/0025390 | A1* | 1/2020 | Lee | F24C 15/101 |

FOREIGN PATENT DOCUMENTS

| | | | |
|---|---|---|---|
| GB | 2241777 | A | 9/1991 |
| JP | 2003302066 | A | 10/2003 |

* cited by examiner

*Primary Examiner* — Jason Lau
(74) *Attorney, Agent, or Firm* — Michael E. Tschupp; Brandon G. Braun; Andre Pallapies

(57) ABSTRACT

A home cooking appliance includes a rear vent trim at a rear side of the top of the housing that is configured to guide flue gases exiting from an exhaust channel of a cooking compartment in an upward direction out of the housing. The rear vent trim includes a body, a back panel closing a rear side of the body, and a heat shield disposed between the back panel and the flue gases flowing in the rear vent trim. The heat shield is spaced from the back panel and forms an air gap between the back panel and the heat shield.

17 Claims, 19 Drawing Sheets

200

200

HOME APPLIANCE HAVING A LOW BACK REAR VENT TRIM

FIELD OF THE INVENTION

The present invention is directed to a home cooking appliance having a low back rear vent trim, and more particularly, to a home cooking appliance having a low back rear vent trim that exhausts flue gases exiting from an exhaust channel in the upward direction out of the rear vent trim and includes a heat shield disposed between a back panel of the rear vent trim and the flue gases flowing in the rear vent trim.

BACKGROUND OF THE INVENTION

A conventional home cooking appliance, such as a free standing range, includes a housing having a cooking compartment, such as a baking oven, convection oven, steam oven, warming drawer, etc., and a cooking surface formed, for example, by cooking grates disposed over gas burners on top of the housing. A conventional range (e.g., slide-in, free standing, etc.) is installed in a cooking area of a home kitchen with a rear wall of the appliance facing a back wall of the kitchen. The appliance may be disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall of the kitchen behind the appliance, acceptable temperatures of cabinets or components over the range or adjacent to the range, as well as acceptable door and other surface temperatures for the appliance, during high temperature events, such as during a normal baking and/or self-cleaning cycle of the oven while all burners on the cooktop are on a highest heat setting. To comply with the industry standards and regulations, an appliance must be able to exhaust flue gases from the cooking compartment while maintaining acceptable door temperatures of the appliance, acceptable surface temperatures of the appliance, acceptable temperatures of a combustible back wall of the kitchen behind the appliance, and acceptable temperatures of cabinets or components over the range or adjacent to the range.

SUMMARY OF THE INVENTION

The present invention recognizes that conventional appliances may include various structures and techniques designed to manage and dissipate the hot air being exhausted from the appliance in order to attempt to comply with the industry standards and regulations. Some conventional appliances use costly designs and door construction that increase the air flow through the door and the housing, and/or use greater air flow and louder fans. Some conventional free standing ranges may be provided with a rear vent trim kit or assembly, which may adapt the free standing range for the environment in which the free standing range is placed. For example, some appliances may be configured to be positioned such that the rear wall is close to a combustible surface, such as a back wall of a kitchen. Given the excessive temperatures potentially seen within an exhaust channel of an oven, the present invention recognizes that during operation of a cooking compartment, heat from the hot flue gases being exhausted through a rear vent trim can be transferred to the rear wall of the appliance, thereby increasing a temperature of the rear wall of the appliance. The temperature of the rear wall of the appliance during operation may greatly affect a required minimum clearance between the rear wall of the appliance and a combustible back wall of the kitchen, compliance with industry standards, etc.

A conventional "low back" trim kit may be provided to adapt a free standing range for placement with a rear wall of the appliance adjacent to a back wall of a home kitchen. Such a low back trim kit may be arranged to space the free standing range away from a back wall of a kitchen so that air is permitted to circulate between the appliance and the back wall of the kitchen to keep the back wall of the kitchen at a cooler temperature than a temperature of the free standing range. The present invention recognizes that such conventional "low back" trim solutions also may direct a flow of hot flue gases being exhausted from the cooking compartment forward over a cooktop of the appliance in order to keep the hot flue gases away from the back wall of the kitchen. However, this may result in the hot flue gases being undesirably directed toward a user of the appliance, which may result in discomfort to the user and/or safety concerns associated with undesirable heating of other surfaces, such as undesirably heating surfaces of a control panel or control knobs of the appliance, the housing of the appliance, etc.

These problems and others are addressed by the present invention, which provides a home cooking appliance including a housing having a cooktop on a top of the housing and a cooking compartment in the housing, an exhaust channel that exhausts flue gases from the cooking compartment, and a rear vent trim at a rear side of the top of the housing and configured to guide the flue gases exiting from the exhaust channel in an upward direction out of the housing, the rear vent trim including a body having a front surface, a first side surface, a second side surface, and an upper surface, the upper surface including at least one opening in fluid communication with the exhaust channel, the at least one opening configured to permit the flue gases exiting from the exhaust channel to flow in the upward direction out of the rear vent trim, a back panel closing a rear side of the body, and a heat shield disposed between the back panel and the flue gases flowing in the rear vent trim, wherein the heat shield is spaced from the back panel and forms an air gap between the back panel and the heat shield. In this way, the present invention can provide a low back rear vent trim that controls a flow of flue gases exhausting from the appliance and can exhaust the flue gases in an upward direction from the rear vent trim away from a user, thereby limiting or reducing heat exposure to the user and increasing safety and usability of the appliance, while at the same time reducing an amount of heat transferred from the flue gases to the back panel of the appliance, which in turn limits or reduces excessive heat exposure to a back wall of the kitchen.

In some exemplary embodiments, the heat shield can include one or more angled flanges configured to induce turbulent flow in the flue gases exiting in the upward direction from at least one opening of the rear vent trim. In other exemplary embodiments, the air gap between the back panel and the heat shield can be configured to guide cooling air in the upward direction between the back panel and the heat shield. In some exemplary embodiments, the rear vent trim can include side shields spaced from the side surfaces of the body of the rear vent trim. In still other exemplary embodiments, the back panel and/or the heat shield can include a plurality of embosses to support the heat shield on the back panel in a spaced manner from the back panel. In other exemplary embodiments, the back panel can include a stiffening rib extending along a portion of the back panel to prevent bowing or warping of the back panel during operation of the appliance. In still other exemplary embodiments, the rear vent trim can include one or more standoff brackets on a rearward facing surface of the back panel for providing a minimum clearance between the back panel and a back wall of the kitchen.

The exemplary embodiments can provide a low back rear vent trim having a heat shield capable of simply and efficiently preventing or isolating (e.g., completely preventing or isolating) the back panel of the appliance from being exposed (e.g., directly exposed) to flue gases being exhausted from one or more exhaust channels as the flue gases flow through the rear vent trim with a limited number of parts, thereby simplifying the overall complexity of the appliance while minimizing manufacturing costs. In addition to isolating the back panel from exposure to flue gases, the exemplary embodiments of the low back rear vent trim can provide an air gap between the heat shield and the back panel of the appliance configured to permit cooler air (e.g., air other than the flue gases, such as cooling air being circulated through the housing, outside air drawn through openings in the housing, etc.) to flow upward between the rear surface of the heat shield and the front surface of the back panel, thereby further reducing the temperature of these surfaces. The cooler air can be guided between the rear face or surface of the heat shield and the front face or surface of the back panel and then exhausted in an upward direction (e.g., vertical direction) from one or more openings in the upper surface of the rear vent trim, thereby forming a cooler curtain of air flowing along or hugging the back wall of the kitchen.

The exemplary embodiments of the low back rear vent trim can reduce an amount of heat that is transferred from the hot flue gases from the exhaust channel that flow over the front face or surface of the heat shield to the back panel, thereby limiting or reducing a temperature of the back panel during operation of the cooking compartment, which in turn limits or reduces the temperature exposure to a back wall of the kitchen. The exemplary embodiments of the low back rear vent trim can include a heat shield having an angled flange, deflector, or the like configured to direct, deflect, change the direction, etc. of the flow of flue gases flowing upward through the rear vent trim from one or more exhaust channels before, or concurrently as, the flue gases exit upward through one or more openings in the upper surface of the rear vent trim, thereby inducing a turbulent flow in the flue gases exiting in the upward direction from the rear vent trim. This turbulent flow in the flue gases can facilitate mixing of the hot flue gases with cooler ambient air and/or cooling air flowing upward from the rear vent trim from the air gap between the heat shield and the back panel of the appliance, thereby further reducing a temperature of the exhausted air, which in turn limits or reduces the temperature exposure to a back wall of the kitchen.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
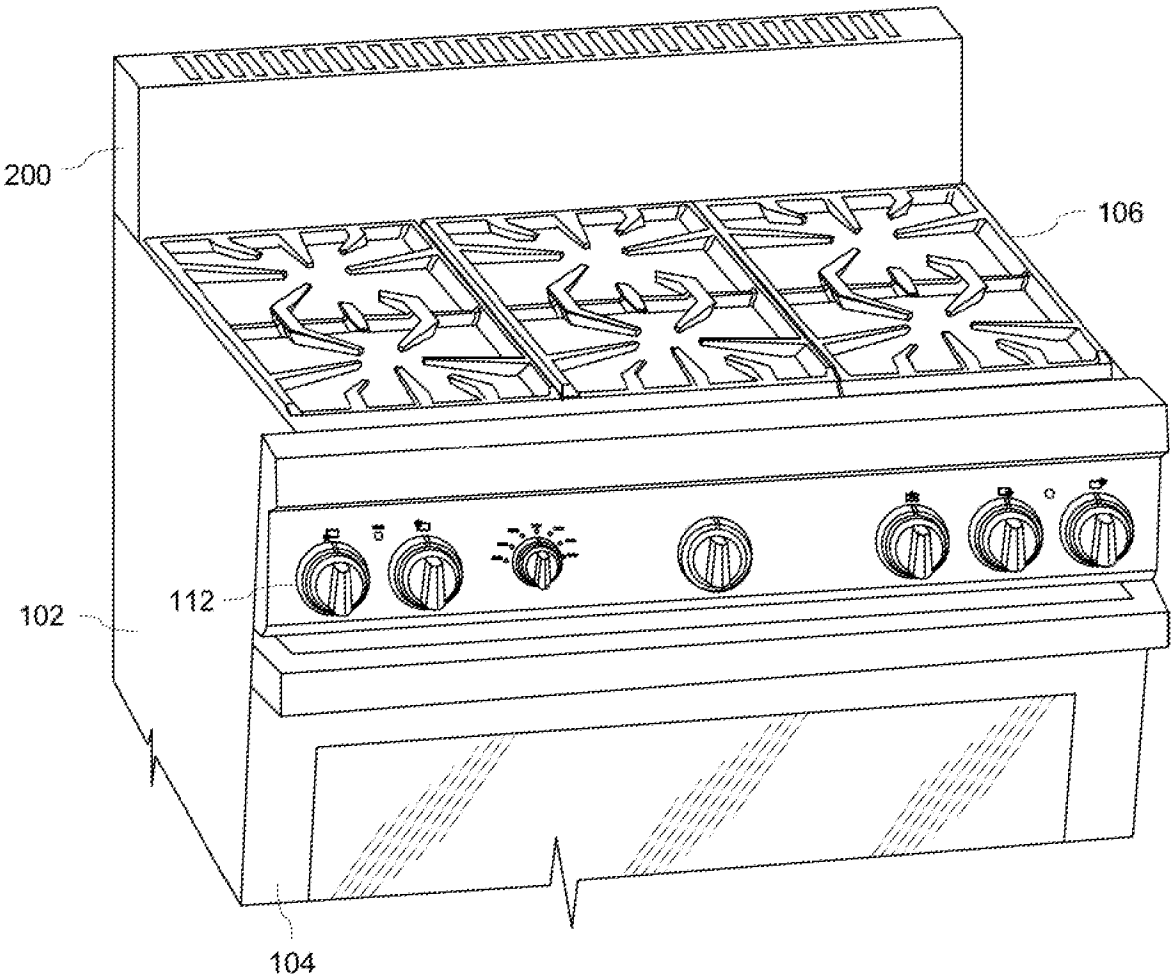
FIG. 1 is a partial, perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-19 illustrate exemplary embodiments of a home cooking appliance having a rear vent trim.

With reference to FIGS. 1-3B, an exemplary embodiment of a home cooking appliance 100, such as a free standing range (FSR), will first be described. The home cooking appliance 100 can include a housing 102 with one or more cooking compartments 110, such as a baking oven, convection oven, steam oven, warming drawer, etc., in the housing 102 and accessible through a door 104 in a front of the housing 102. The home cooking appliance 100 can include a cooking surface 106 on a top of the housing 102. The cooking surface 106 can include, for example, one or more cooking grates having an upper surface for supporting cookware over one or more gas burners 108. The appliance is not limited to the illustrated embodiment, and can additionally or alternatively include other cooking compartments, such as one or more baking ovens, convection ovens, steam ovens, warming drawers, broil burner, etc., or one or more cooking surfaces, such as a griddle, an induction cooktop with a glass ceramic cooking surface, etc. The appliance 100 can include a control panel having a plurality of user input features, such as one or more control knobs 112 for controlling the operation of the burners 108, the cooking compartment, etc.

The housing 102 can include a rear vent trim 200 for exhausting air from within the appliance, such as hot flue gases from one or more oven compartments 110 conveyed by one or more exhaust channels 114 (e.g., oven flues). The rear vent trim 200 can take various forms depending on the particular appliance, arrangement of cooking compartment (s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim 200 can be configured to be raised up from the cooking surface by various amounts such as a high back, low back, high shelf, etc. In the illustrated example, the housing 102 includes a low back rear vent trim 200 on the top of the housing 102 and at a rear side of the cooking surface 106. The rear vent trim 200 extends upward from the top of the appliance and includes a body 220 having an upper surface with one or more openings 222 (e.g., vent cutouts) for exhausting air from within the appliance, including flue gases from one or more exhaust channels 114. The rear vent trim 200 is configured to control and manage the flow of the exhausted air (e.g., hot air/flue gas) to minimize temperatures on a user and adjacent surfaces, such as surfaces of kitchen cabinetry adjacent to or above the appliance, surfaces of a combustible back wall (see BW in FIG. 2) of the kitchen, etc. In this way, the rear vent trim 200 can improve compliance of the appliance with industry standards and regulations and maintain passing combustion results at the gas burners 108, while also improving comfort of a user, for example, by minimizing a temperature of air flowing toward the user, minimizing noise to the user, etc.

Figure 2:
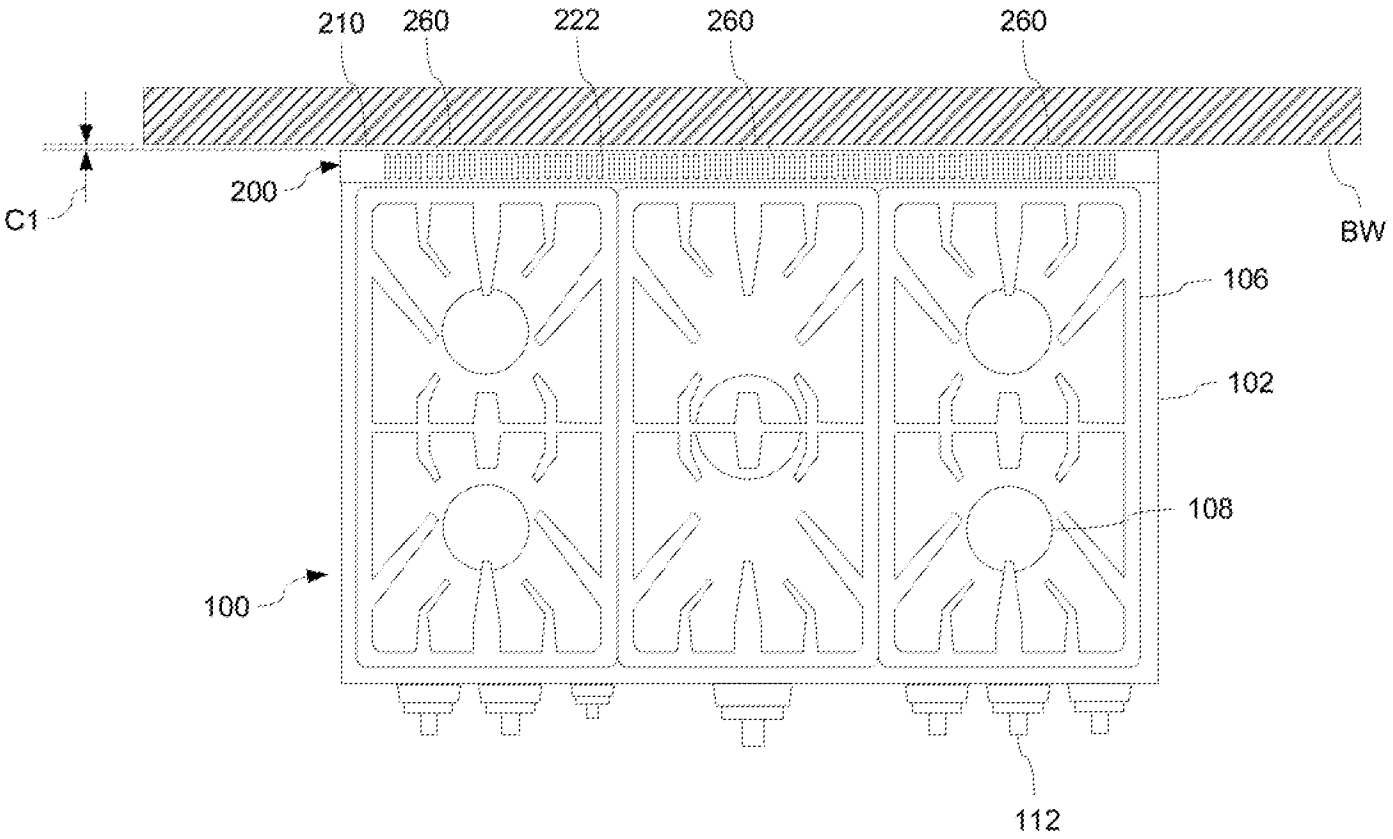
FIG. 2 is a top view of a home cooking appliance according to an exemplary embodiment of the invention.

As shown in FIG. 2, the appliance 100 can be configured to be positioned such that a back panel 210 of the rear vent trim 200 is close to a combustible surface, such as a back wall BW of a kitchen. The temperature of the back panel 210 of the appliance 100 during operation of the appliance greatly affects a required minimum clearance C1 between the back panel 210 of the appliance 100 and a combustible back wall BW of the kitchen, in order to minimize heat transfer from the back panel 210 to the back wall BW of the kitchen. As will be explained in greater detail with reference to the exemplary embodiments, an example of a rear vent trim 200 can include one or more stand-off brackets 260 or the like to maintain a predetermined minimum clearance C1 between the back panel 210 and the back wall BW of the kitchen. The present invention recognizes that, during operation of the cooking compartment, heat from the hot flue gases being exhausted from one or more exhaust channels 114 through the rear vent trim 200 can be transferred to the back panel 210 of the appliance, thereby increasing a temperature of the back panel 210, which may affect the required minimum clearance C1. The exemplary embodiments provide a rear vent trim 200 that is capable of reducing the amount of heat transferred from the oven exhaust channels 114 to the back panel 210 of the appliance or an accessory of the appliance, thereby limiting or reducing the temperature exposure to a back wall BW of the kitchen to which the back panel 210 of the appliance 100 is adjacent. The present invention can minimize a required minimum clearance C1 between the back panel 210 of the appliance 100 and a combustible back wall BW of the kitchen, which faces the back panel 210 of the appliance, while maintaining compliance with industry standards and regulations. The exemplary embodiments provide a rear vent trim 200 that is capable of directing hot exhaust air upwards from the rear vent trim 200 rather than forwards towards the user, thereby further increasing safety of the overall appliance 100.

With reference to FIGS. 3A-19, exemplary embodiments of a rear vent trim 200 for a home cooking appliance 100 will now be described. The rear vent trim 200 can include a body 220 having, for example, a front surface, a first side surface, a second side surface, and an upper surface. The body 220 can be formed, for example, by a weldment of components, such as a weldment of stainless steel panels forming a rectangular structure with an open rear side. The upper surface of the body 220 can include one or more openings 222 in fluid communication with the exhaust channel 114. The one or more openings 222 can be configured to permit the flue gases A1 exiting from the exhaust channel 114 to flow in an upward direction out of the rear vent trim 200. The rear vent trim 200 can include a back panel 210 closing a rear side of the body 220. A height of the back panel 210 can be larger (e.g., taller) than the height of the open rear side of the body 220 such that the back panel 210 can extend further downward than the open rear side of the body 220, for example, to close an additional region of the housing 102, to facilitate coupling of the rear vent trim 200 to the housing 102, and/or to facilitate guiding of cooling air used to cool components of the appliance 100 upward along the rear of the housing 102 and out of the housing 102. One of ordinary skill in the art will recognize that the body 220 and back panel 210 can have other arrangements and configurations within the spirit and scope of the invention, such as a body without an open rear side, a body with a partially open rear side, a back panel 210 integrally formed with the body 220, etc. In the illustrated examples, the rear vent trim 200 is a so-called low back rear vent trim in which the rear vent trim 200 extends up from the rear side of the top of the housing 102. In these examples, the upper surface of the body 220 of the rear vent trim 200 is disposed at an elevated position with respect to the cooking surface 106 on the top of the housing 102. However, other types, arrangements, and configurations of a rear vent trim can be provided.

As shown in FIGS. 4-10, in some examples, the back panel 210 can include one or more stiffening ribs 212 or the like extending along a portion of the back panel 210. Such stiffening ribs 212 can provide structure or support to the back panel 210 to minimize or prevent bowing or warping of the back panel 210 due to heating of the back panel 210 during operation of the appliance 100, such as during high heat output cooking operations, self-cleaning operations, etc. In the illustrated examples, the back panel 210 includes a pair of laterally extending stiffening ribs 212 stamped into a surface of the back panel 210. However, other configurations of one or more stiffening ribs 212 are possible, such as vertical or angled ribs, discrete ribs coupled to the back panel 210, etc.

The rear vent trim 200 can include one or more standoff brackets 260 on a rearward facing surface of the back panel 210 such that the standoff brackets 260 extend closer to a back wall BW of a kitchen than the back panel 220 of the housing 102 of the appliance 100 to provide a predetermined clearance C1 between the appliance 100 and the back wall BW of the kitchen. The exemplary standoff brackets 260 can have various shapes or configurations and can be separate components coupled to the back panel 210 or components that are integrally formed with, or stamped into, the back panel 210. In some examples, a plurality of standoff brackets 260 can be spaced across a width of the rear vent trim 200. The number of standoff brackets 260 may vary depending on features of a particular model of appliance, such as a width of a particular appliance.

The back panel 210 can include one or more openings configured to couple the back panel 210 to the housing 102 or another component of the appliance 100, as well as cutouts, louvers, or other features to facilitate a flow of air, such as cooling air, into or out of the back of the appliance 100.

With reference again to FIGS. 3A-17, the rear vent trim 200 can include one or more heat shields 230 spaced from an inward facing surface of the back panel 210. The heat shield 230 can include a plate portion having a front surface configured to be exposed (e.g., directly exposed) to flue gases A1 being exhausted from the one or more exhaust channels 114 and to guide the flue gases A1 in the upward direction through the body 220. The heat shield 230 can include a rear surface facing the back panel 210. The heat shield 230 can be supported on the back panel 210 such that the heat shield 230 is spaced from the back panel 210 to form an air gap G between a rear face or surface of the heat shield 230 and a front face or surface of the back panel 210. The heat shield 230 can be configured to prevent or isolate (e.g., completely prevent or isolate) the back panel 210 from being exposed (e.g., directly exposed) to flue gases A1 being exhausted from the one or more exhaust channels 114 as the flue gases A1 flow through the rear vent trim 200.

Figure 3A:
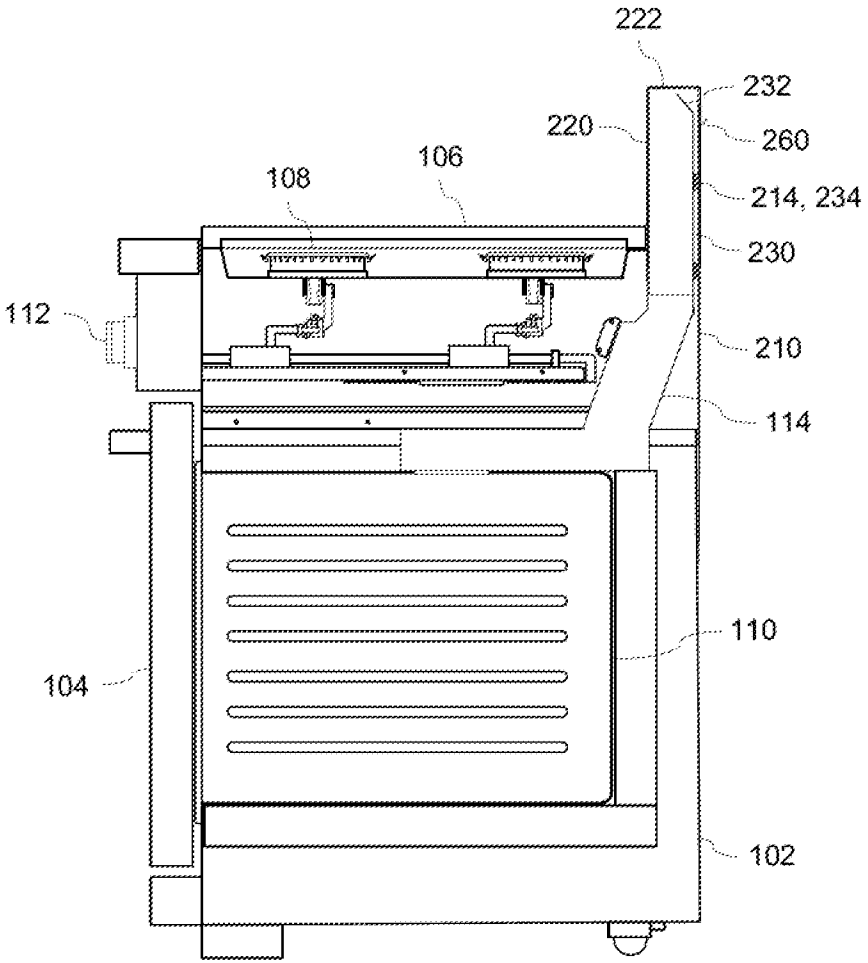
FIGS. 3A and 3B are schematic cutaway side views of a home cooking appliance according to an exemplary embodiment of the invention.
Figure 3B:
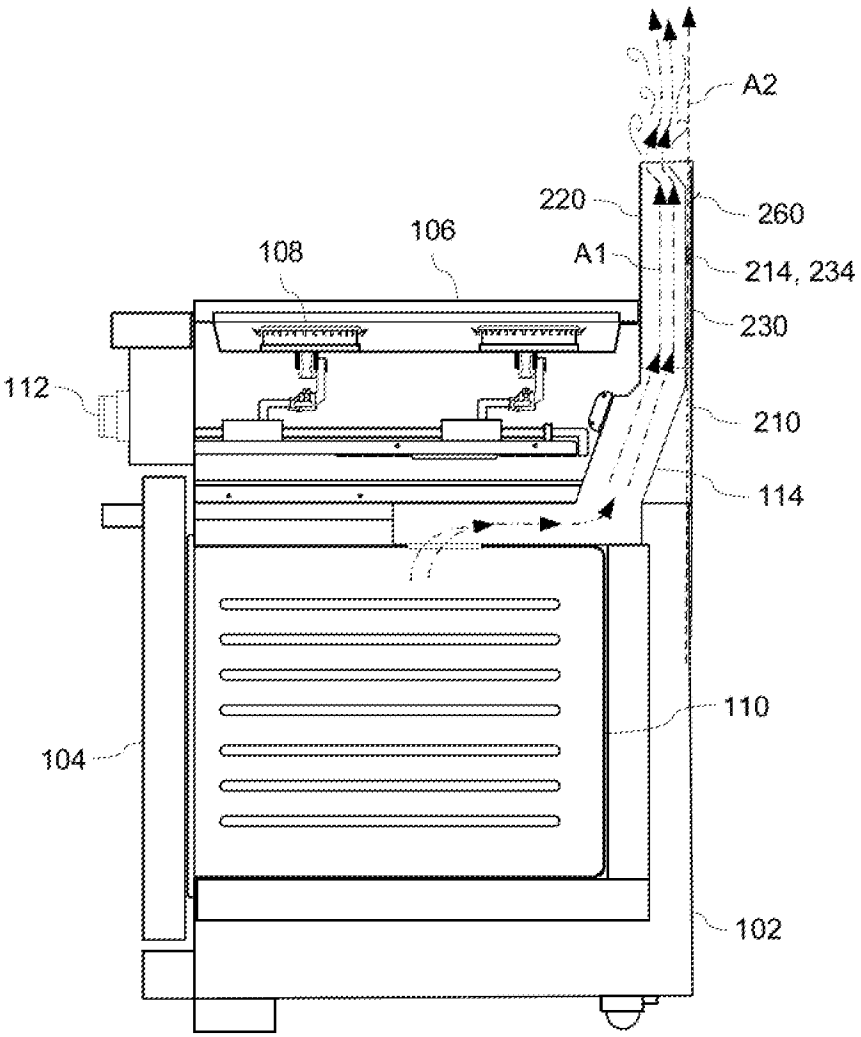
Figure 4:
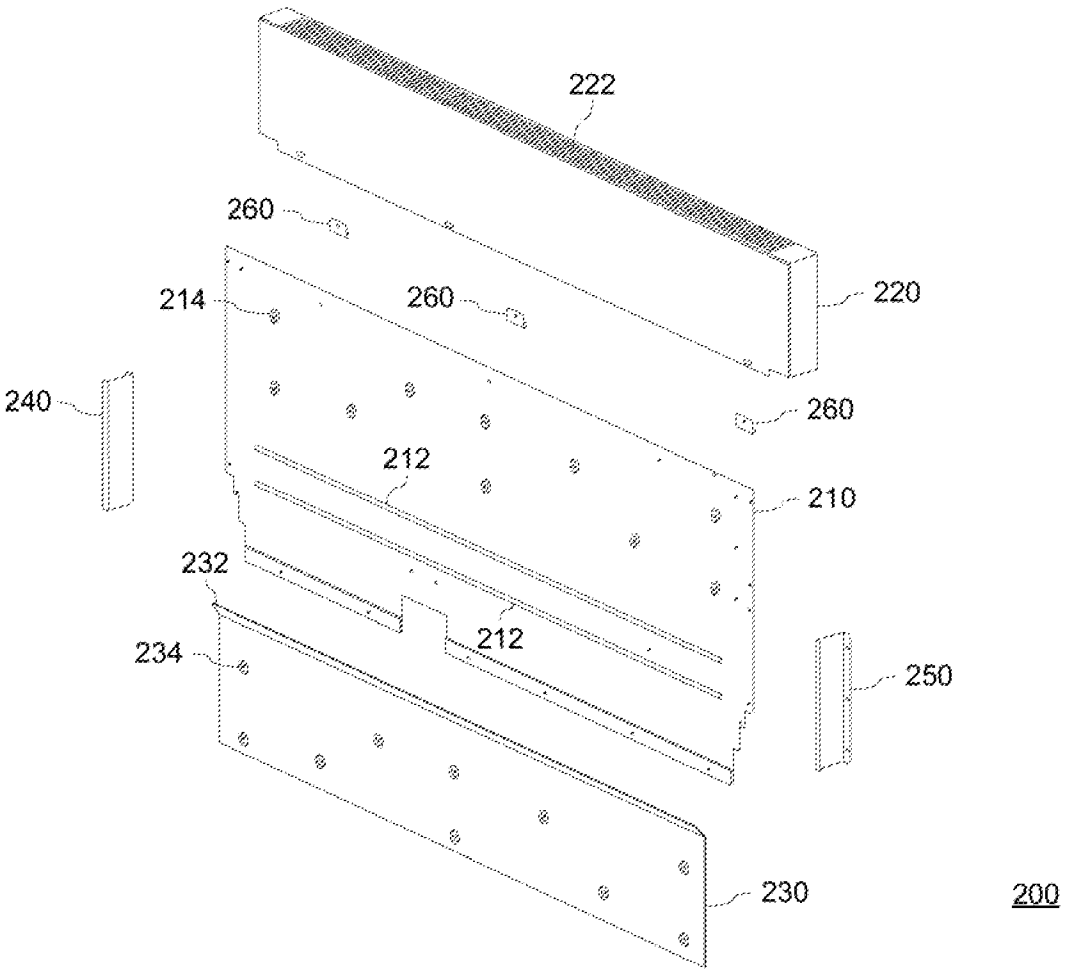
FIG. 4 is an exploded view of a rear vent trim of a home cooking appliance according to an exemplary embodiment of the invention.
Figure 5:
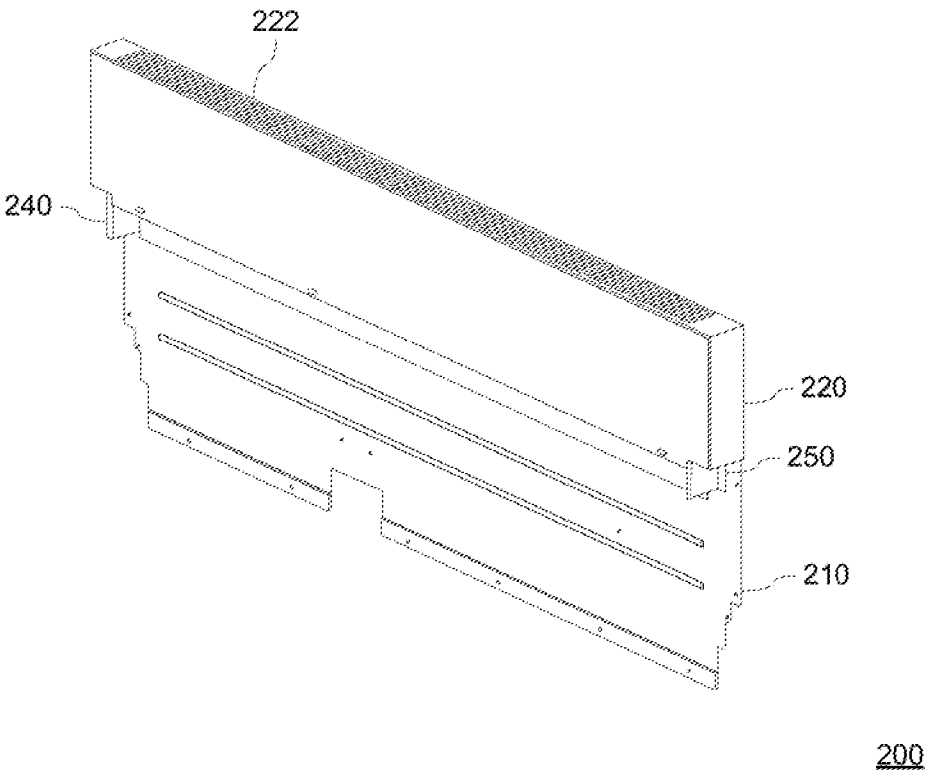
FIG. 5 is a front perspective view of a rear vent trim of a home cooking appliance according to an exemplary embodiment of the invention.
Figure 6:
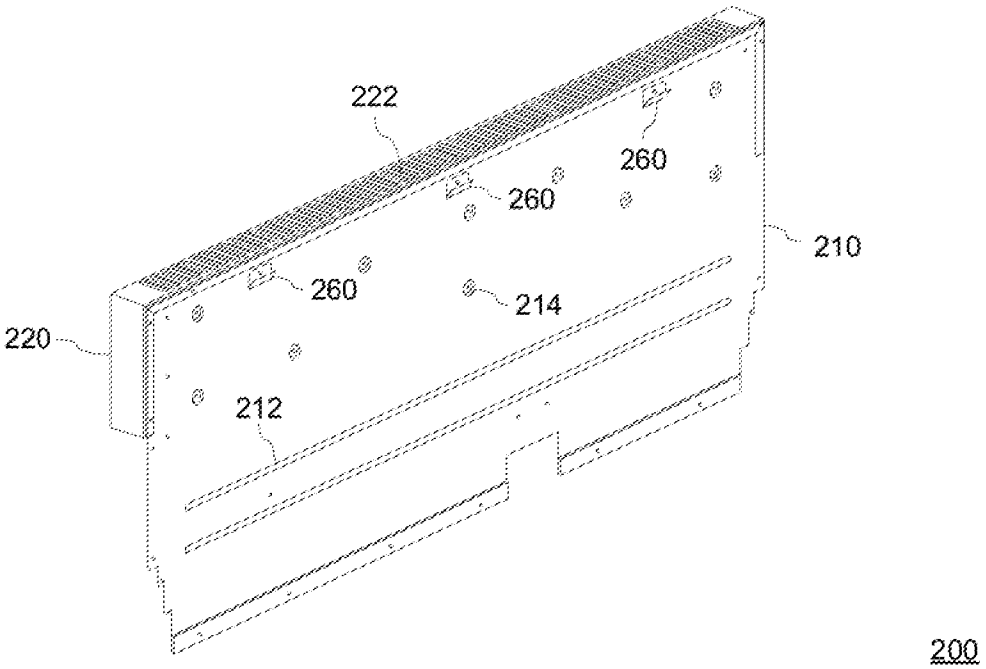
FIG. 6 is a rear perspective view of a rear vent trim of a home cooking appliance according to an exemplary embodiment of the invention.
Figure 7:
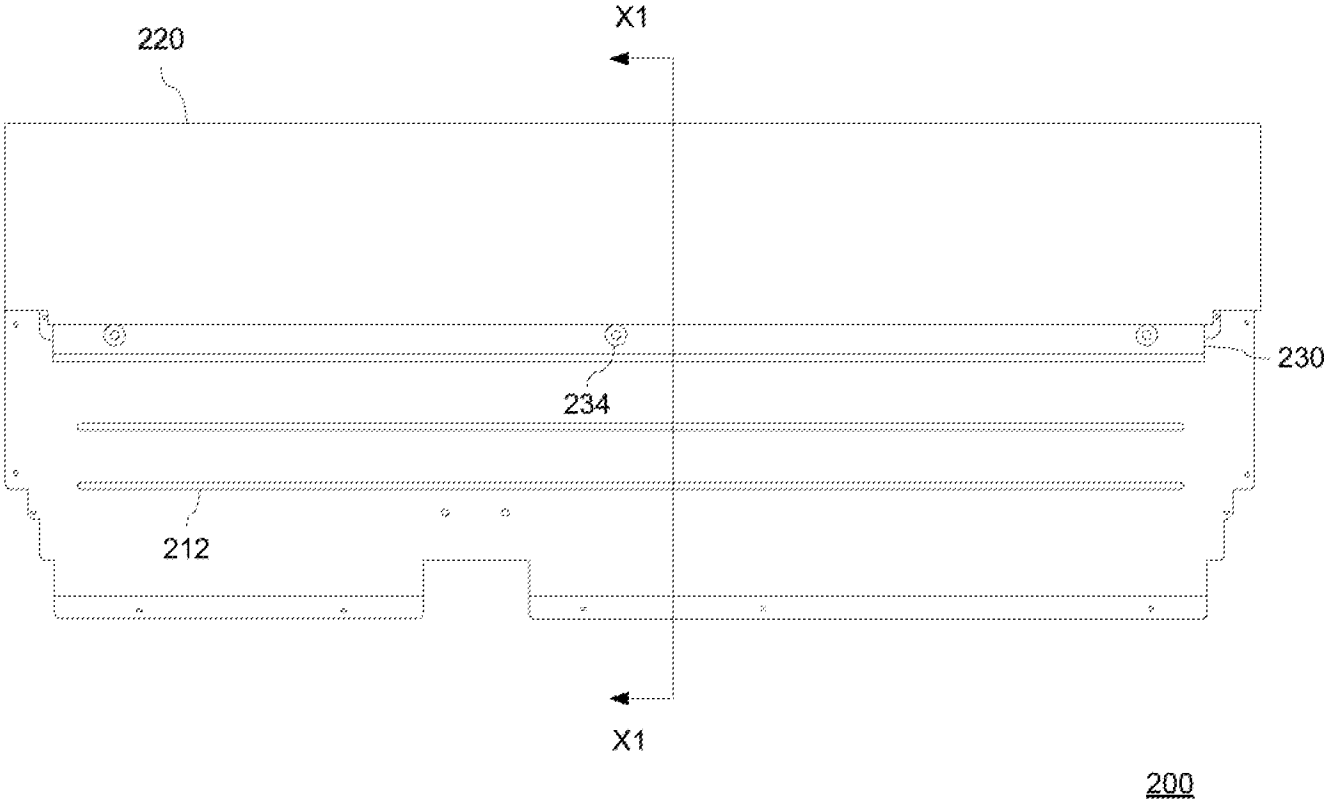
FIG. 7 is a front view of a rear vent trim of a home cooking appliance according to an exemplary embodiment of the invention.
Figure 8:
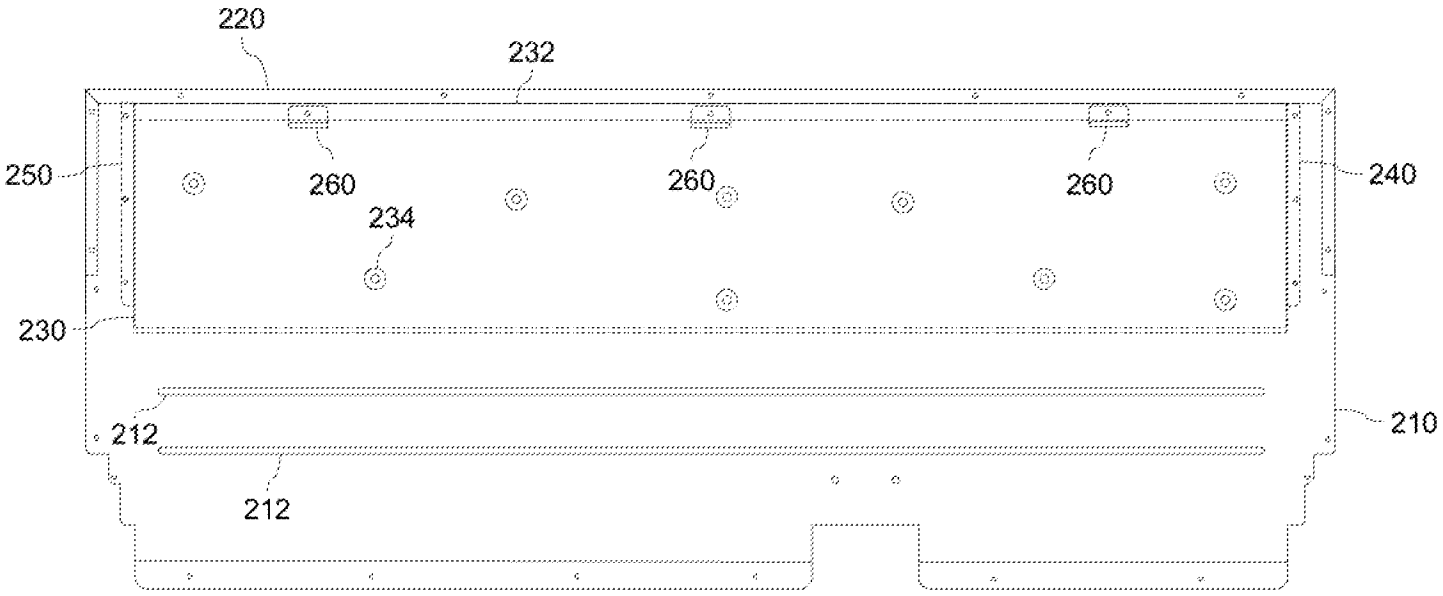
FIG. 8 is a rear view of a rear vent trim of a home cooking appliance according to an exemplary embodiment of the invention.
Figure 10:
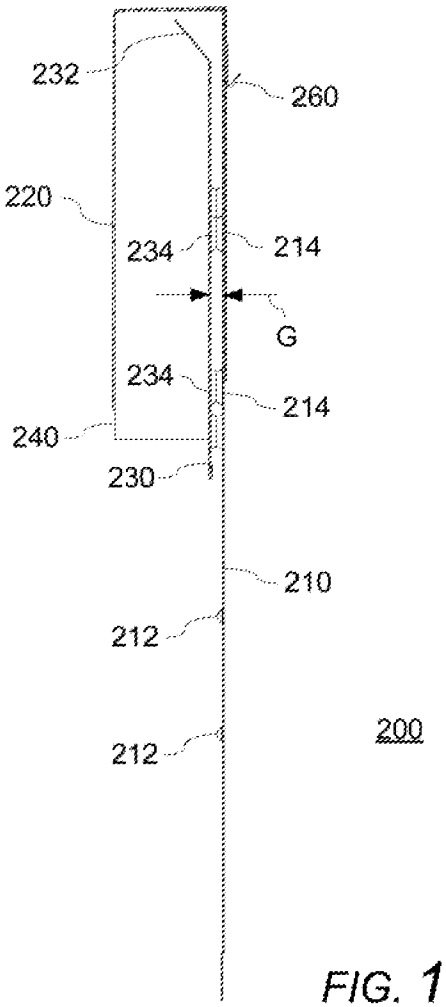
FIG. 10 is a cross-sectional, side view of a rear vent trim of a home cooking appliance taken along Section X1-X1 of FIG. 7.
Figure 9:
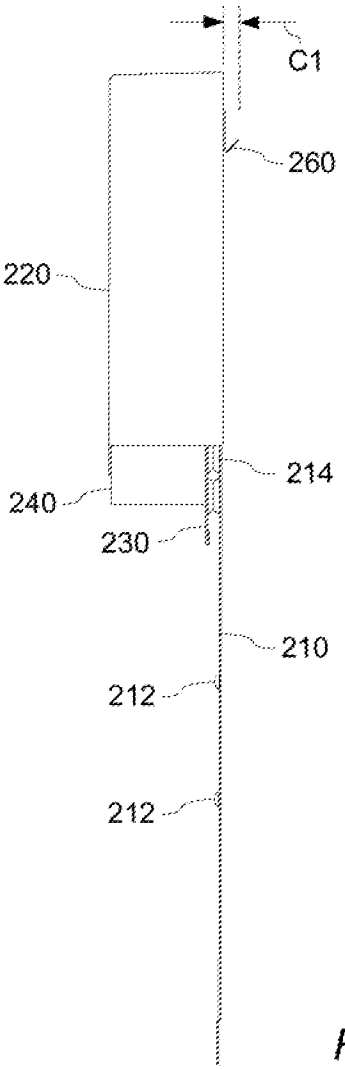
FIG. 9 is a side view of a rear vent trim of a home cooking appliance according to an exemplary embodiment of the invention.
Figure 11:
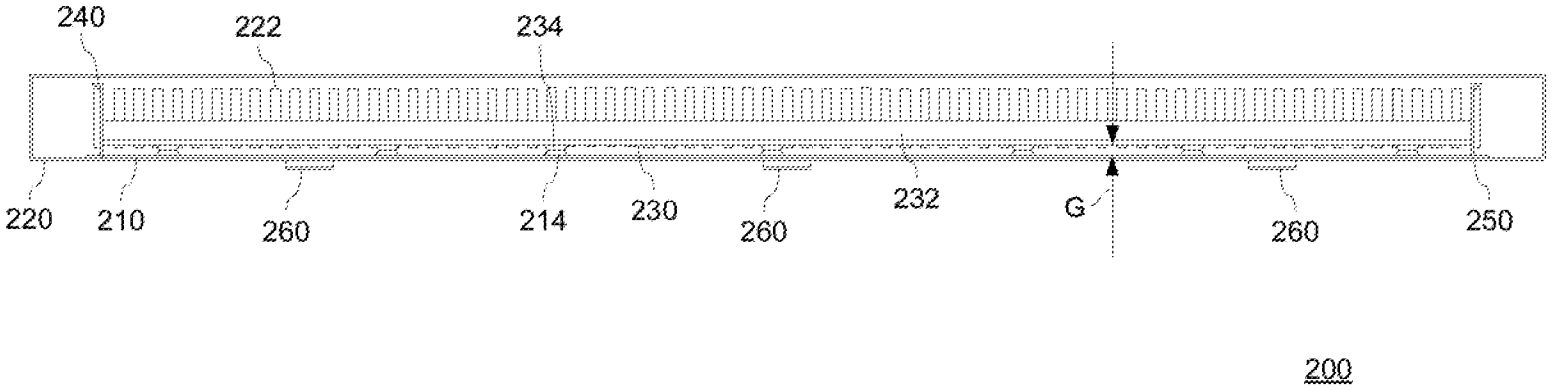
FIG. 11 is a bottom view of a rear vent trim of a home cooking appliance according to an exemplary embodiment of the invention.
Figure 12:
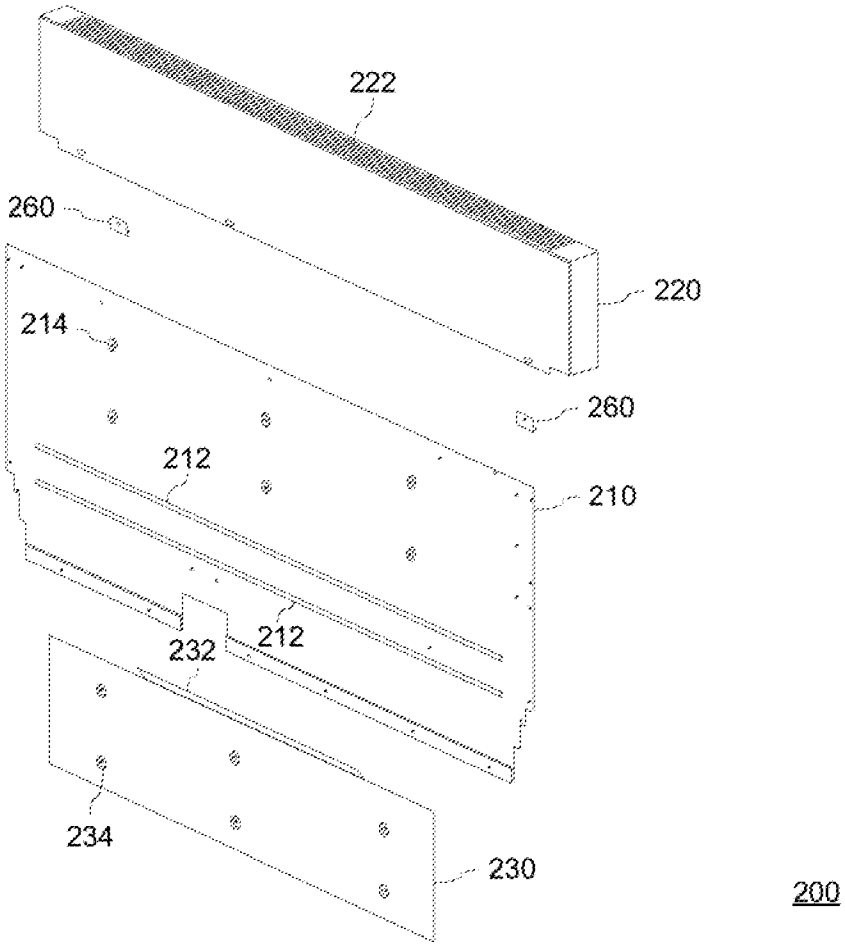
FIG. 12 is an exploded view of a rear vent trim of a home cooking appliance according to another exemplary embodiment of the invention.
Figure 13:
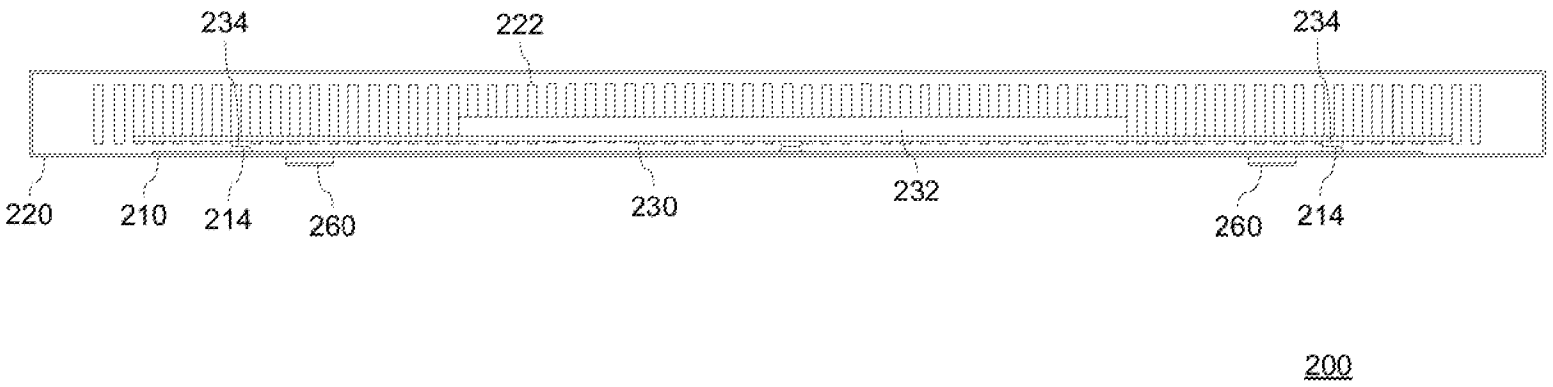
FIG. 13 is a bottom view of a rear vent trim of a home cooking appliance according to the exemplary embodiment of FIG. 12.
Figure 14:
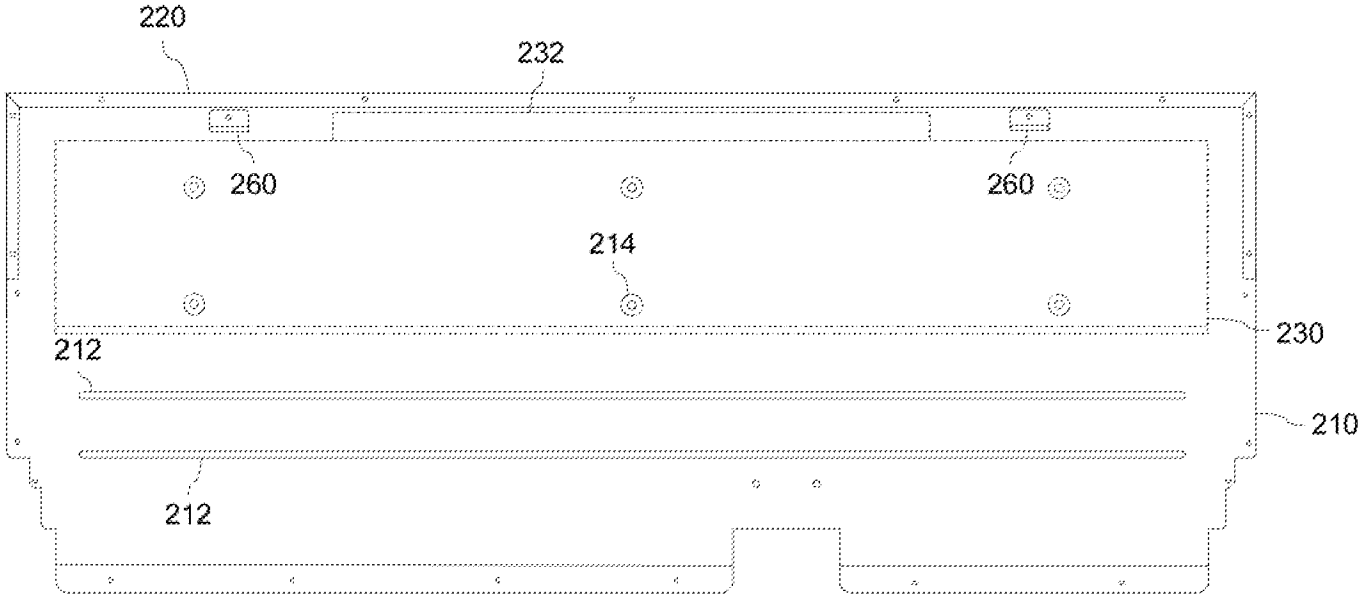
FIG. 14 is a rear view of a rear vent trim of a home cooking appliance according to the exemplary embodiment of FIG. 12.

As shown, for example, in FIGS. 3B, 10, and 11, in addition to isolating the back panel 210 from being exposed to flue gases A1, the air gap G also can be configured to permit cooler air A2 (e.g., air other than the flue gases A1, such as cooling air being circulated through the housing 102, outside air drawn through openings in the housing 102, etc.) to flow upward between the rear surface of the heat shield 230 and the front surface of the back panel 210, thereby further reducing the temperature of these surfaces. The cooler air A2 can be guided between the rear face or surface of the heat shield 230 and the front face or surface of the back panel 210 and then exhausted in an upward direction (e.g., vertical direction) from one or more openings in the upper surface of the body 220, thereby forming a cooler curtain of air A2 flowing along or hugging the back wall BW of the kitchen.

The location, size, and shape of the heat shield 230 can vary depending on a type and configuration of an appliance, the particular physical dimensions of one or more components of an appliance such as an amount of available space between the exit of the exhaust channel 114 and the upper surface of the body 220, the number of cooking compartments and/or flues and the respective exhaust channel location(s), the air flow through the exhaust channel, etc. A plate portion of the heat shield 230 can be configured to be parallel (or substantially parallel) to the front surface of the body 220 and/or the back panel 210. In other exemplary embodiments, the plate portion of the heat shield 230 can be configured to be at an angle with respect to the front surface of the body 220 and/or the back panel 210.

Figure 18:
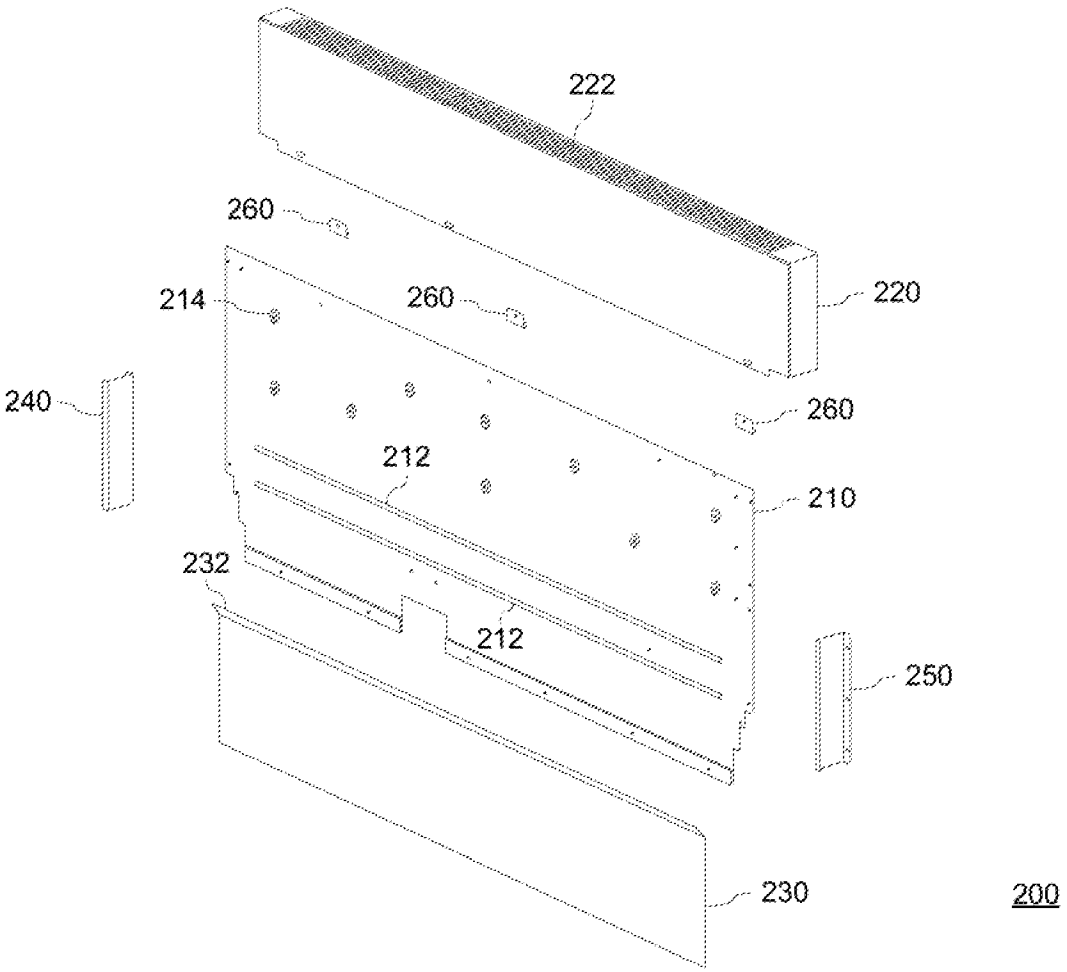
FIG. 18 is an exploded view of a rear vent trim of a home cooking appliance according to another exemplary embodiment of the invention.
Figure 19:
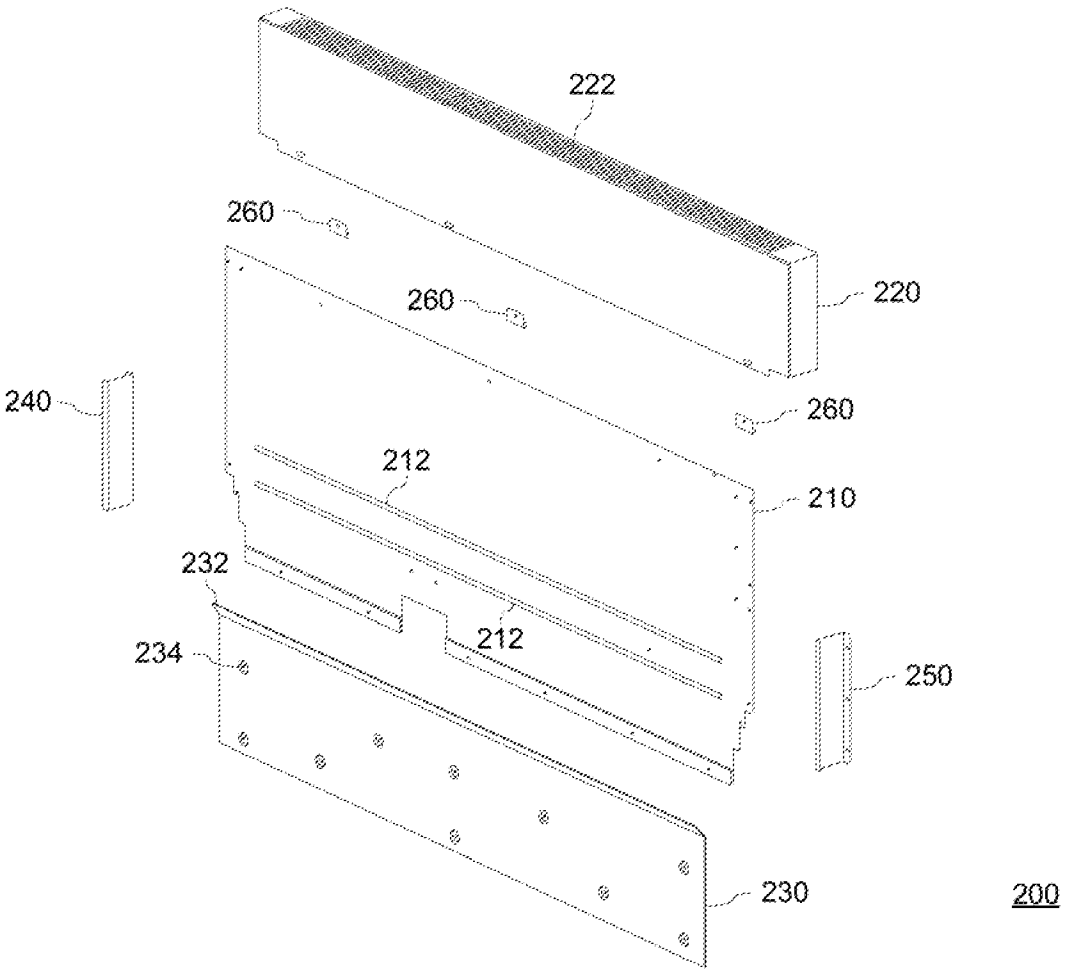
FIG. 19 is an exploded view of a rear vent trim of a home cooking appliance according to another exemplary embodiment of the invention.

In the examples in FIGS. 3A-17, the back panel 210 can include a plurality of first embosses 214 facing the heat shield 230 and the heat shield 230 can include a plurality of corresponding second embosses 234 facing the back panel 210. The embosses 214 can be coupled or secured to the embosses 234 to support the heat shield 230 on the back panel 210 in a spaced manner from the back panel 210 with only minimal direct physical contact. In other examples, the back panel 210 can include a plate portion having a plurality of embosses 214, and a plate portion of the heat shield 230 can be coupled to or secured to the embosses 214 of the back panel 210 such that the heat shield 230 is spaced from the back panel 210 with only minimal direct physical contact, as shown in FIG. 18. In still other examples, the heat shield 230 can include a plate portion having a plurality of embosses 234 that are coupled to or secured to a plate portion of the back panel 210 to support the heat shield 230 on the back panel 210 in a spaced manner from the back panel 210 with only minimal direct physical contact, as shown in FIG. 19. A plurality of fasteners or other fixation devices, such as one or more rivets, screws, welds, and/or heat resistant adhesives, or the like, can couple or secure the embosses 214, 234 to each other or to the plate surface of the heat shield 230 or back panel 210, or the embosses 214, 234 can be configured to engage each other or engage the plate surface of the heat shield 230 or back panel 210. As a result, the heat transfer from one solid to another solid (e.g., metal to metal) can be substantially limited to heat transfer through the embosses and/or one or more fixation devices. Accordingly, the heat shield 230 can reduce an amount of heat that is transferred from the hot flue gases from the exhaust channel 114 that flow over the front face or surface of the heat shield 230 to the back panel 210, thereby limiting or reducing a temperature of the back panel 210 during operation of the cooking compartment, which in turn limits or reduces the temperature exposure to a back wall BW of the kitchen to which the wall 210 of the appliance 100 is adjacent.

The location, size, and configuration of the embosses 214, 234 can vary depending on a type and configuration of an appliance, such as the number of cooking compartments and/or flues in the appliance, the heat output of the appliance, etc. For example, the embosses 214, 234 can have a circular shape or another shape. The embosses 214, 234 can be arranged to avoid or minimize proximity to particularly high temperature locations of the heat shield 230. For example, the embosses 214, 234 can be arranged to avoid being placed directly adjacent to or above the exit of one or more exhaust channels 114, to minimize a number or proximity of embosses 214, 234 with respect to the exit of one or more exhaust channels 114, etc. The embosses 214 and/or 234 can have a unique arrangement (e.g., non-symmetrical) that permits installation and assembly of the heat shield 230 on the back panel 210 in only a single possible position, thereby insuring that the heat shield 230 can only be installed in the correct position. The embosses 214 and/or 234 can be integrally formed on one or more of the heat shield 230 and/or the back panel 210 or separate components coupled to one or more of the heat shield 230 and/or the back panel 210.

With reference again to FIGS. 3A-17, the heat shield 230 can include an angled flange, deflector, or the like 232 configured to direct, deflect, change the direction, etc. of the flow of flue gases A1 flowing upward through the body 220 of the rear vent trim 200 from the one or more exhaust channels 114 before, or concurrently as, the flue gases A1 exit upward through the one or more openings 222 in the upper surface of the body 220 of the rear vent trim 200, thereby inducing a turbulent flow in the flue gases A1 exiting in the upward direction from the at least one opening of the rear vent trim, as schematically illustrated by the dashed airflow lines shown in FIG. 3B. This turbulent flow in the flue gases A1 can facilitate mixing of the hot flue gases A1 with cooler ambient air and/or cooling air A2, thereby further reducing a temperature of the air A1, which in turn limits or reduces the temperature exposure to a back wall BW of the kitchen.

The angled flange 232 can extend from an upper edge of the heat shield 230. In some examples, as shown in the examples illustrated in FIGS. 4-11, the angled flange 232 can extend along an entire length of the upper edge of the heat shield 230 or substantially an entire length of the upper edge of the heat shield 230 (e.g., between the side shields 240, 250 described below with reference to FIGS. 15-17). In other examples, the angled flange 232 can extend along only a portion of a length of the upper edge of the heat shield 230, such as along only a central portion of the length of the upper edge of the heat shield 230, as shown in the examples illustrated in FIGS. 12-17. The angled flange 232 can be centered along the length of the heat shield 230 or offset from the center. In other examples, the angled flange 232 can extend from other parts or regions of the heat shield 230, such as from a face of the heat shield 230. The angled flange 232 can be a single, continuous flange or a plurality of angled flanges 232 can be provided. The angled flange 232 can be integrally formed with the heat shield 230 or a separate component coupled to a part of the heat shield 230. In the illustrated examples, the angled flange 232 is a planar flange. However, in other examples, the flange 232 can have multiple angles and/or have one or more curved portions.

The location, size, and shape of one or more angled flanges 232 on the heat shield 230 can vary depending on a type and configuration of an appliance, such as the number of cooking compartments and/or flues in the appliance, the heat output of the appliance, the desired turbulent flow to be induced, etc. The angled flange 232 can extend from the heat shield 230 at a predetermined angle to induce the desired turbulent flow in the vertical direction.

With reference again to FIGS. 3A-17, the side edges or lateral ends of the heat shield 230 can be spaced from the side surfaces of the body 220. In some examples, the rear vent trim 200 can include a pair of side shields 240, 250 spaced from the side surfaces of the body 220. The side shields 240, 250 can be disposed between the side edges or lateral ends of the heat shield 230 and the side surfaces of the body 220. Each of the side shields 240, 250 can include an inward facing surface configured to guide the flue gases A1 in the upward direction through the body 220 and an outward facing surface facing the respective side surface of the body 220 and spaced from the respective side surface of the body 220 by a predetermined amount. The inward facing surfaces of the side shields 240, 250 can extend vertically to guide the flue gases A1 vertically upward through the body 220. In some examples, the inward facing surfaces of the side shields 240, 250 can extend at an angle to guide the flue gases A1 through the body 220.

Figure 15:
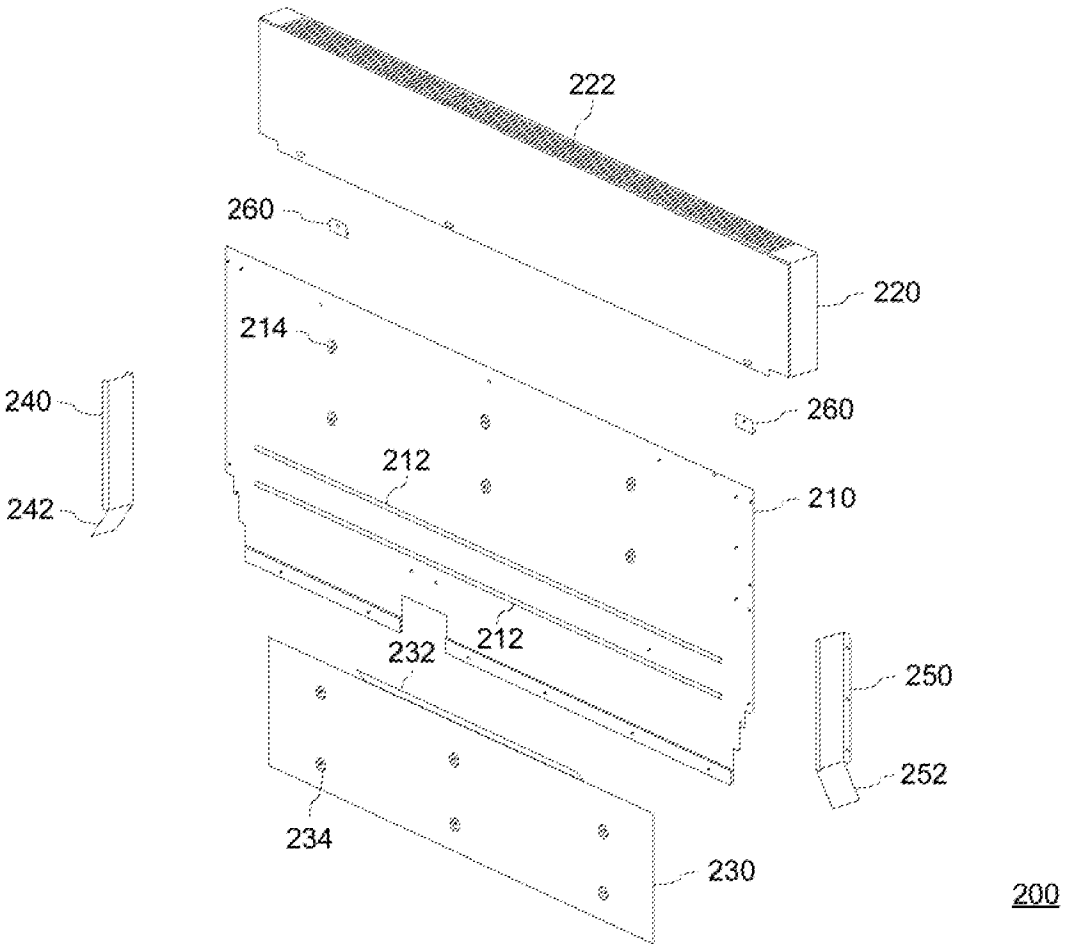
FIG. 15 is an exploded view of a rear vent trim of a home cooking appliance according to another exemplary embodiment of the invention.
Figure 16:
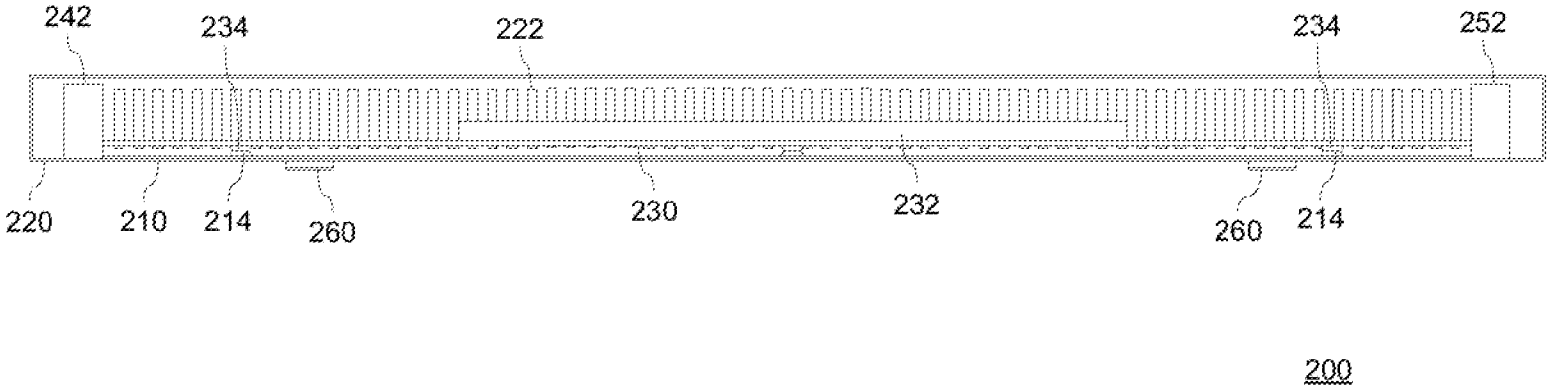
FIG. 16 is a bottom view of a rear vent trim of a home cooking appliance according to the exemplary embodiment of FIG. 15.
Figure 17:
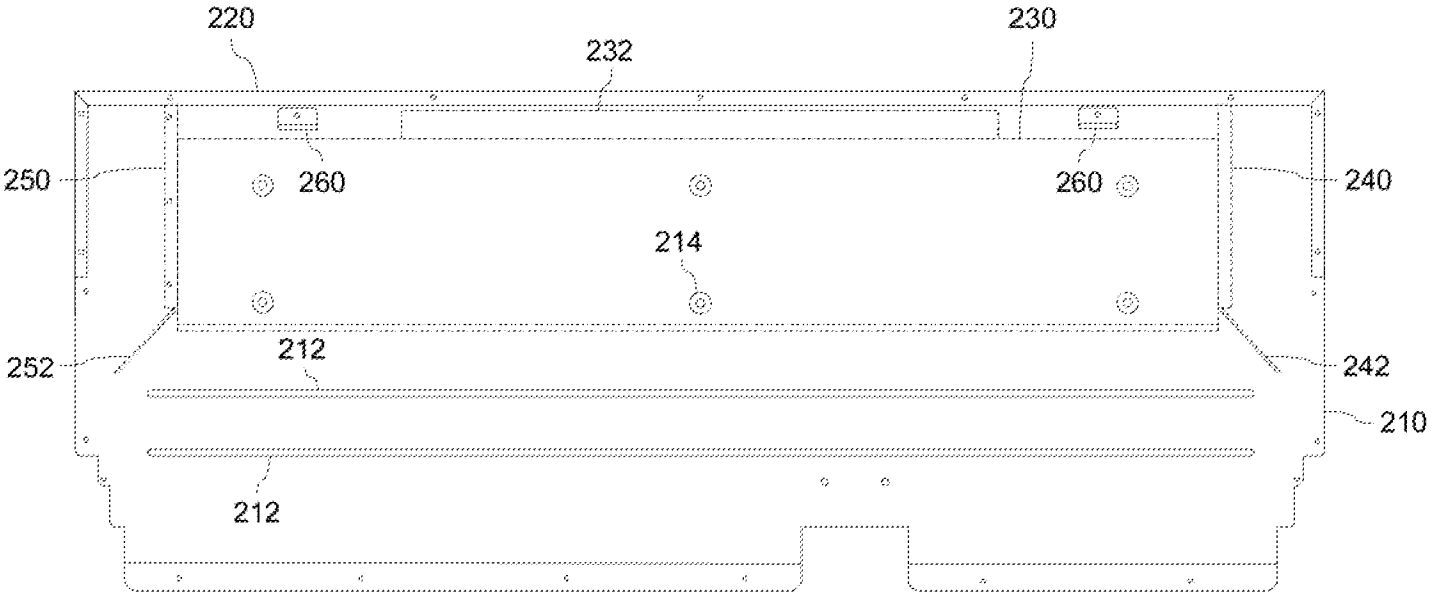
FIG. 17 is a rear view of a rear vent trim of a home cooking appliance according to the exemplary embodiment of FIG. 15.

In other examples, as shown for example in FIGS. 15-17, the side shields 240, 250 can include one or more angled elements 242, 252 (e.g., flanges, plates, etc.) extending therefrom (e.g., extending toward the exit of the exhaust channel 114) to more efficiently guide the flue gases A1 exiting the exhaust channel 114 into the space defined by the inward facing surfaces of the heat shield 230, side shields 240, 250, and front wall of the body 220.

The side shields 240, 250 can include one or more features for fastening the side shields 240, 250 to the body 220 and/or back panel 210, such as one or more flanges configured to be coupled to the body 220 and/or back panel 210, for example, via one or more rivets, screws, welds, and/or heat resistant adhesives, or the like.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a cooktop on a top of the housing and a cooking compartment in the housing;

an exhaust channel that exhausts flue gases from the cooking compartment; and a rear vent trim at a rear side of the top of the housing and configured to guide the flue gases exiting from the exhaust channel in an upward direction out of the housing, the rear vent trim including:

a body having a front surface, a first side surface, a second side surface, and an upper surface, the upper surface including at least one opening in fluid communication with the exhaust channel, the at least one opening configured to permit the flue gases exiting from the exhaust channel to flow in the upward direction out of the rear vent trim;

a back panel closing a rear side of the body of the vent trim, the back panel forming a back of the appliance configured to be adjacent to a back wall of a kitchen; and a heat shield disposed adjacent to the back panel, and between the back panel and the flue gases flowing in the rear vent trim, wherein the heat shield is spaced from the back panel and forms an air gap between the back panel and the heat shield, wherein the back panel or the heat shield has a plurality of embosses and the heat shield is supported on the back panel by the plurality of embosses such that the heat shield is spaced from the back panel.

2. The home cooking appliance of claim 1, wherein the heat shield includes:

a front surface configured to guide the flue gases in the upward direction through the body; and a rear surface spaced from a forward facing surface of the back panel.

3. The home cooking appliance of claim 1, wherein side edges of the heat shield are spaced from the first side surface and the second side surface, respectively.

4. The home cooking appliance of claim 1, wherein the heat shield includes an angled flange configured to induce turbulent flow in the flue gases exiting in the upward direction from the at least one opening of the rear vent trim.

5. The home cooking appliance of claim 4, wherein the angled flange extends from an upper edge of the heat shield.

6. The home cooking appliance of claim 5, wherein the angled flange extends along an entire length of the upper edge of the heat shield.

7. The home cooking appliance of claim 5, wherein the angled flange extends along only a portion of a length of the upper edge of the heat shield.

8. The home cooking appliance of claim 7, wherein the angled flange is centered along the length of the heat shield.

9. The home cooking appliance of claim 1, wherein the rear vent trim includes a first side shield spaced from the first side surface of the body and a second side shield spaced from the second side surface of the body.

10. The home cooking appliance of claim 9, wherein the first side shield includes an inward facing surface configured to guide the flue gases in the upward direction through the body and an outward facing surface facing the first side surface of the body and spaced from the first side surface of the body, and wherein the second side shield includes an inward facing surface configured to guide the flue gases in the upward direction through the body and an outward facing surface facing the second side surface of the body and spaced from the second side surface of the body.

11. The home cooking appliance of claim 1, wherein the back panel includes a stiffening rib extending along a portion of the back panel.

12. The home cooking appliance of claim 11, wherein the stiffening rib is stamped into the back panel.

13. A home cooking appliance comprising:

a housing having a cooktop on a top of the housing and a cooking compartment in the housing;

an exhaust channel that exhausts flue gases from the cooking compartment; and a rear vent trim at a rear side of the top of the housing and configured to guide the flue gases exiting from the exhaust channel in an upward direction out of the housing, the rear vent trim including:

a body having a front surface, a first side surface, a second side surface, and an upper surface, the upper surface including at least one opening in fluid communication with the exhaust channel, the at least one opening configured to permit the flue gases exiting from the exhaust channel to flow in the upward direction out of the rear vent trim;

a back panel closing a rear side of the body; and a heat shield disposed between the back panel and the flue gases flowing in the rear vent trim, wherein the heat shield is spaced from the back panel and forms an air gap between the back panel and the heat shield, wherein the rear vent trim includes at least one standoff bracket on a rearward facing surface of the back panel.

14. The home cooking appliance of claim 1, wherein the upper surface of the body of the rear vent trim is disposed at an elevated position with respect to the rear side of the top of the housing.

15. The home cooking appliance of claim 1, wherein the air gap between the back panel and the heat shield is configured to guide cooling air in the upward direction between the back panel and the heat shield.

16. A home cooking appliance comprising:

a housing having a cooktop on a top of the housing and a cooking compartment in the housing;

an exhaust channel that exhausts flue gases from the cooking compartment; and a rear vent trim at a rear side of the top of the housing and configured to guide the flue gases exiting from the exhaust channel in an upward direction out of the housing, the rear vent trim including:

a body having a front surface, a first side surface, a second side surface, and an upper surface, the upper surface including at least one opening in fluid communication with the exhaust channel, the at least one opening configured to permit the flue gases exiting from the exhaust channel to flow in the upward direction out of the rear vent trim;

a back panel closing a rear side of the body of the vent trim, the back panel forming a back of the appliance configured to be adjacent to a back wall of a kitchen; and a heat shield disposed adjacent to the back panel, and between the back panel and the flue gases flowing in the rear vent trim, wherein the heat shield is spaced from the back panel and forms an air gap between the back panel and the heat shield, wherein the back panel includes a plurality of first embosses facing the heat shield and the heat shield includes a plurality of second embosses facing the back panel, and wherein the plurality of first embosses are secured to the plurality of second embosses to support the heat shield on the back panel in a spaced manner from the back panel.

17. The home cooking appliance of claim 16, wherein the rear vent trim includes a plurality of fasteners securing the plurality of first embosses to the plurality of second embosses.

* * * * *